US005175388A

United States Patent [19]

Maher et al.

[11] Patent Number: 5,175,388

[45] Date of Patent: Dec. 29, 1992

[54] AMMUNITION BUCKET CARRIERS FOR MAGAZINE CONVEYORS

[75] Inventors: David L. Maher, Burlington; Paul A. Trahan, St. Albans, both of Vt.

[73] Assignee: General Electric Company, Burlington, Vt.

[21] Appl. No.: 812,537

[22] Filed: Dec. 23, 1991

[51] Int. Cl.[5] ..... F42B 39/08

[52] U.S. Cl. ..... 89/35.01; 89/33.16

[58] Field of Search ..... 89/35.01, 35.02, 46, 89/33.14, 33.16, 33.2, 33.25

[56] References Cited

U.S. PATENT DOCUMENTS

| | | | |
|---|---|---|---|
| 2,365,028 | 12/1944 | Vesely | 89/35.01 |
| 2,475,380 | 7/1949 | Elder | 89/35.01 |
| 2,494,728 | 1/1950 | Stacey et al. | 89/33.16 |
| 3,580,131 | 5/1971 | Zimmerman | 89/34 |
| 4,125,052 | 11/1978 | Thomas | 89/34 |
| 4,166,408 | 9/1979 | Wetzel et al. | 89/33.02 |
| 4,619,181 | 10/1986 | Pehker et al. | 89/34 |
| 4,724,739 | 2/1988 | Heberlein | 89/33.2 |
| 4,951,547 | 8/1990 | Novet et al. | 89/34 |
| 5,097,742 | 3/1992 | Gaye et al. | 89/35.01 |

FOREIGN PATENT DOCUMENTS

| | | | |
|---|---|---|---|
| 53-31400 | 3/1978 | Japan | 89/46 |
| 109491 | 1/1944 | Switzerland | 89/35.01 |

*Primary Examiner*—Stephen M. Johnson
*Attorney, Agent, or Firm*—Stephen A. Young

[57] ABSTRACT

To reliably hold rounds of ammunition on a magazine conveyor, each of a series of ammunition round carriers has a semi-cylindrical bucket providing an axially elongated slot along which are arrayed integral, roller tipped resilient fingers defining a slot opening of a width less than the ammunition round diameter. Forced insertion and withdrawal of a round through the slot opening is accommodated by flexure of the fingers and facilitated by rolling engagement with the rollers. The rollers are pressed against an ammunition round in a bucket by the clamping forces of the fingers to impose both lateral and axial motion restraints on the round to secure its carrier position.

20 Claims, 5 Drawing Sheets

AMMUNITION BUCKET CARRIERS FOR MAGAZINE CONVEYORS

The present invention relates to ammunition conveyors and particularly to ammunition round carriers therefor.

BACKGROUND OF THE INVENTION

Heretofore, the task of handling ammunition for large caliber field artillery pieces, such as howitzers, has been highly labor intensive and time consuming. To reduce the number of military personnel required and to save time, automated handling equipment has been proposed for conveying large caliber ammunition into and out of magazine storage pursuant to rearming a weapons vehicle, such as a tank, and loading its cannon.

One approach to automating the handling of artillery ammunition is to provide an ammunition conveyor trained throughout the interior of a magazine. While the conveyor is in motion, ammunition rounds are handed off to the conveyor during uploading and are handed off from the conveyor during downloading. While the conveyor is stopped, the uploaded ammunition rounds remain in magazine storage positions on the conveyor. Uploading and downloading can thus be accomplished expeditiously in a highly automated manner. While mechanizing the handling and storage of large caliber ammunition utilizing a magazine conveyor is not particularly complex, this approach is not without complications. The conveyor should accommodate both projectiles and propellant canisters as separate ammunition units required by howitzers. The magazine conveyor must be capable of safety storing projectiles and propellant canisters during transport over rough terrain in resupply and weapons vehicles. Thus, provisions must be made to secure the positions of the projectiles and propellant canisters on the conveyor during conveyance and while stationary in magazine storage locations. Such provisions must be structurally robust to hold projectiles weighing in the neighborhood of one hundred pounds, must be adapted to different types and sizes of both projectiles and canisters, and also must not hinder uploading and downloading.

SUMMARY OF THE INVENTION

It is accordingly an objective of the present invention to provide an improved ammunition carrier for incorporation in a magazine conveyor to securely hold large caliber ammunition rounds in position on the conveyor while in magazine storage and while being conveyed incident to uploading and downloading the magazine. The carrier is economically constructed to reliably impose both lateral and axial restraints on various types and lengths of ammunition rounds even while subjected to severe vibration and shock loads experienced during vehicle transport at high speeds over rough terrain.

To this end, the ammunition round carrier of the present invention is provided with a semi-cylindrical bucket formed with plural resilient fingers distributed along the edges of an axially elongated slot having a transverse opening width less than the diameter of an ammunition round. The free ends of the fingers rotatably mount rollers bounding the slot opening to facilitate uploading an ammunition round therethrough and into the bucket in a snap-fit manner as the fingers flex between open and closed positions. The rollers engage the ammunition round while contained in the bucket under the clamping forces exerted by the fingers to restrain both lateral and axial movements thereof. Enhanced axial restraint may be provided by the placement of round-engaging friction pads on the inner surface of the bucket and/or a nose stop lanced inwardly from the bucket.

A series of the carriers are connected at regular intervals between a pair of conveyor chains to provide a ladder conveyor which is trained throughout the interior of a magazine typically in a serpentine path. Guides may be positioned along the conveyor in closely spaced relation to the ammunition rounds to prevent them from popping out of the bucket carriers. Also, restraint tabs may be added to the bucket carriers to assume positions preventing ammunition rounds from popping out of adjacent bucket carriers. To accommodate downloading at a 180° turnaround in the serpentine conveyor path, selector gates engage the ammunition round through gaps between adjacent fingers to pop them out of their bucket carriers during movement through the turnaround.

The invention accordingly comprises the features of construction, combinations of elements, and arrangements of parts, all as detailed hereinafter, and the scope of the invention will be indicated in the claims.

BRIEF DESCRIPTION OF THE DRAWINGS

For a full understanding of the nature and objectives of the present invention, reference may be had to the following Detailed Description taken in conjunction with the accompanying drawings, in which.

Corresponding reference numerals refer to like parts throughout the several views of the drawings.

DETAILED DESCRIPTION

Figure 1:
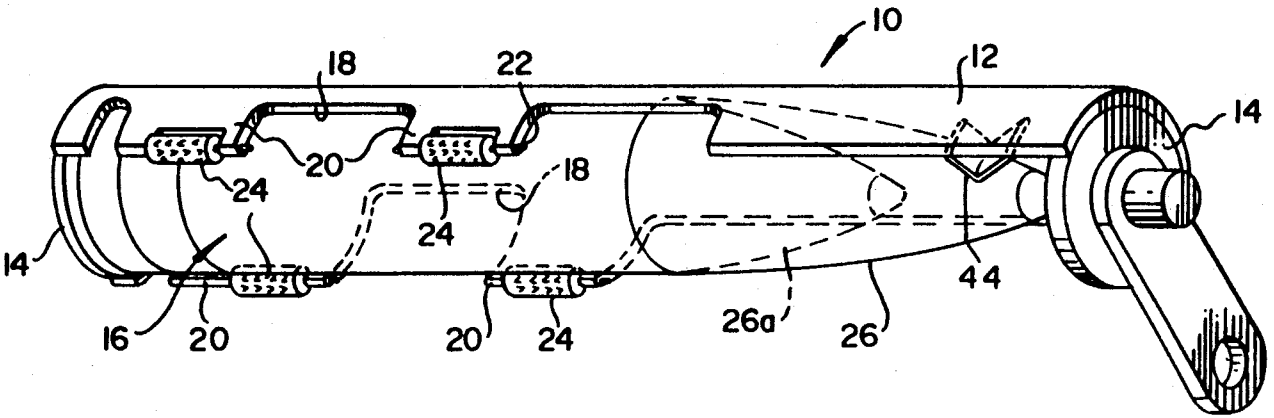
FIG. 1 is a perspective view of a magazine conveyor ammunition round carrier constructed in accordance with an embodiment of the invention.

The ammunition round carrier of the present invention, generally indicated at 10 in FIG. 1, comprises a semi-cylindrical bucket 12 closed off at its ends by circular plates 14. The longitudinal edges of the bucket, which define an axially elongated slot, generally indicated at 16, extending from endplate to endplate, are relieved, as indicated at 18, to provide a plurality of fingers 20 spaced along the slot sides. The free end of each finger is bifurcated in order to mount a longitudinally oriented pin 22 on which is rotatably mounted a roller 24. The bucket is formed of suitable material, such as steel, aluminum or fiber reinforced plastic, of a thickness to provide fingers 20 with an appropriated degree of resiliency. The gaps between circumferentially opposed rollers 24 defined a slot opening whose width is somewhat less than the diameter of the caliber of ammunition to handled. Thus, when an ammunition round is forcibly laterally inserted through the slot opening, fingers 20 flex in opening directions to accommodate insertion and then spring back to press their rollers in clamping engagement with the round contained in the bucket. The axial positions of the fingers along the two sides of the slot are selected to retain ammunition of different axial lengths, such as a long round 26 indicated in solid line and a short round **26*a* indicated in phantom line. Ideally, the center of gravity of either round is aft (left in FIG. 1) of the foremost rollers, but reliable round retention can be achieved if the center of gravity is somewhat forward of the foremost rollers. It will be appreciated that rollers significantly reduce the magnitude of insertion force necessary to upload an ammunition round into the bucket carrier. While FIG. 1** illustrates a single roller mounted by each finger, the finger free end may be multiply bifurcated in the manner of a hinge plate to rotatably mount plural, longitudinally spaced rollers. Also, additional fingers, i.e., more than two, may be provided along each of the slot edges.

Figure 2:
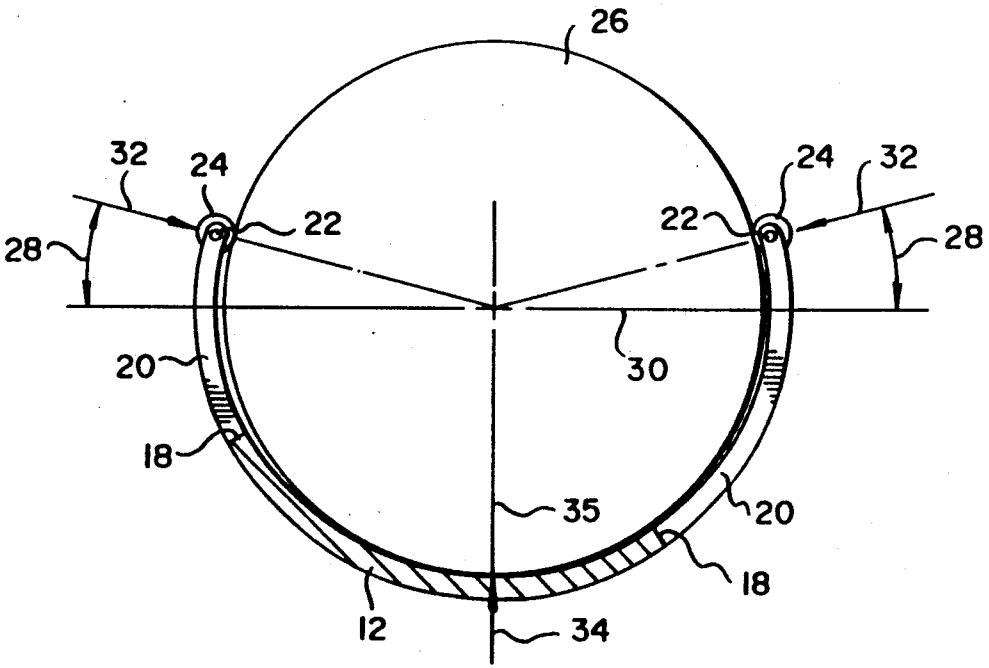
FIG. 2 is a radial sectional view of the carrier of FIG. 1.
Figure 3:
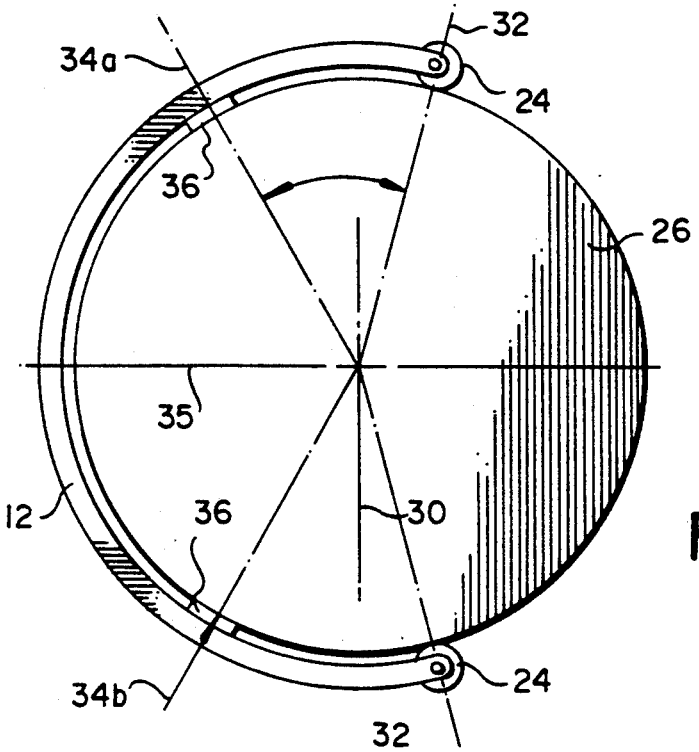
FIG. 3 is a radial sectional view of the carrier of FIG. 1 with the addition of friction pads to enhance axial motion restraint.

In addition to facilitating uploading, the rollers 24 serve the important function of axially restraining axial motion of an ammunition round while confined by the bucket. As seen in FIG. 2, the circumferential extension of the fingers 20 is such as to position rollers 24 in overcenter relation with ammunition round 26. That is, the rollers are positioned at suitable angles 28 beyond ammunition round centerline 30. If, for example, angle 28 is 15°, then the ammunition round is cradled over an included angle of 210°. The resiliency of the fingers exert radially inwardly directed forces 32 which are balanced by a force 34, and these forces combine to produce a total clamping force acting to restrain axial motion of the ammunition round. The maximum potential axial restraining force of course depends on the coefficient of friction of the roller peripheral surfaces and the bucket material where force 34 is concentrated in aligned relation with centerline 35. To increase potential axial restraining force, pads 36 of a high friction material, may be affixed to the interior of bucket 12 in engagement with the ammunition round, as seen in FIG. 3. These pads can be positioned in angularly offset relation to centerline 35, e.g., set back 45° from each roller position. Thus, radial balancing forces **34*a* and 34*b*** are developed at these pads to effectively increase the total clamping force. It will also be appreciated that the rollers also minimize surface abrasion of the ammunition rounds during lateral motion through the slot opening.

Figure 4:
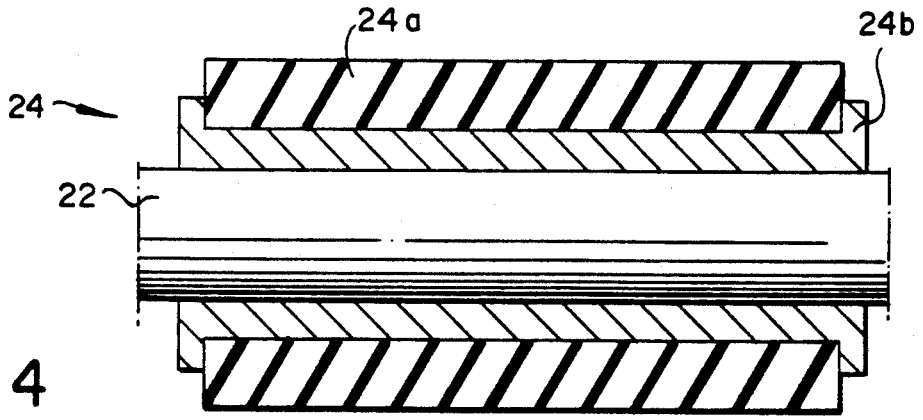
FIGS. 4 and 5 are sectional views of alternative roller constructions for utilization in the carrier of FIG. 1.
Figure 5:
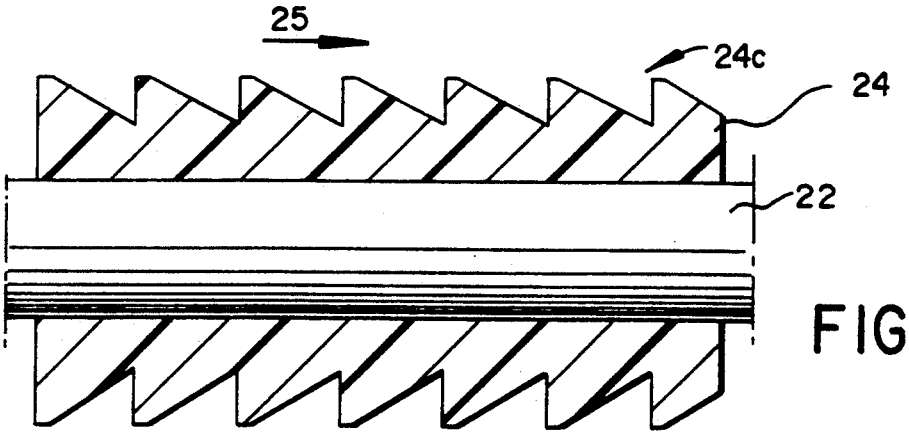

To also enhance axial restraint on the ammunition round while confined in the bucket carrier, each roller 24 may be constructed having an outer sleeve **24*a* of a high friction rubber material molded about a hub 24*b* of a low friction material, such as nylon, as illustrated in FIG. 4. The low friction hub enables the roller to rotate freely on pin 22 to accommodate the desire low insertion force characteristic. Alternatively, the rollers 24 may be formed of a material, such as a moderately hard plastic, e.g., nylon, whose outer surface 24*c*, is serrated in sawtooth fashion to preferentially restrain axial motion of an ammunition round in the direction of arrow 25, as illustrated in FIG. 5**.

Figure 6:
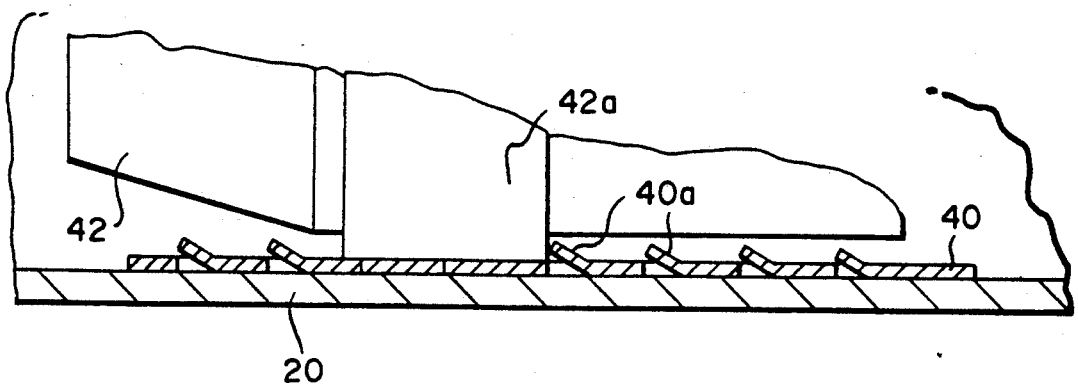
FIG. 6 is a fragmentary sectional view of the carrier of FIG. 1, with the addition of a pad having resilient latching tabs to provide enhanced axial motion restraint.

As a further alternative seen in FIG. 6, a section of the inner surface of the carrier 24 may be covered with a sheet 40 of plastic, metal, or other flexible material from which are lanced outwardly directed resilient tabs **40*a* which engage the rotating band 42*a* of an ammunition round, such as a projectile 42**. Those tabs forward of the rotating band are not depressed and thus are in positions to latchingly engage the forward edge of the rotating band, thereby restraining axial motion of the projectile in the forward or nose-first direction.

Also, as seen in FIG. 1, a nose stop 44 may be lanced from bucket 12 to project inwardly in position to engage the ogive of a projectile and stop axial motion short of the projectile nose impacting bucket endplate 14, regardless of projectile length.

Figure 8:
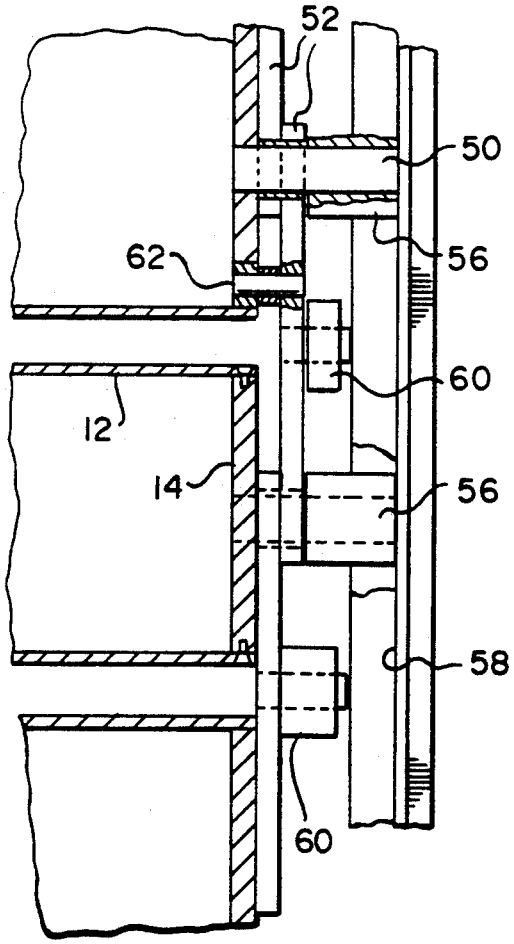
FIG. 8 is a fragmentary plan view, partially broken away, illustrating support and guidance features of the magazine conveyor in FIG. 7.
Figure 7:
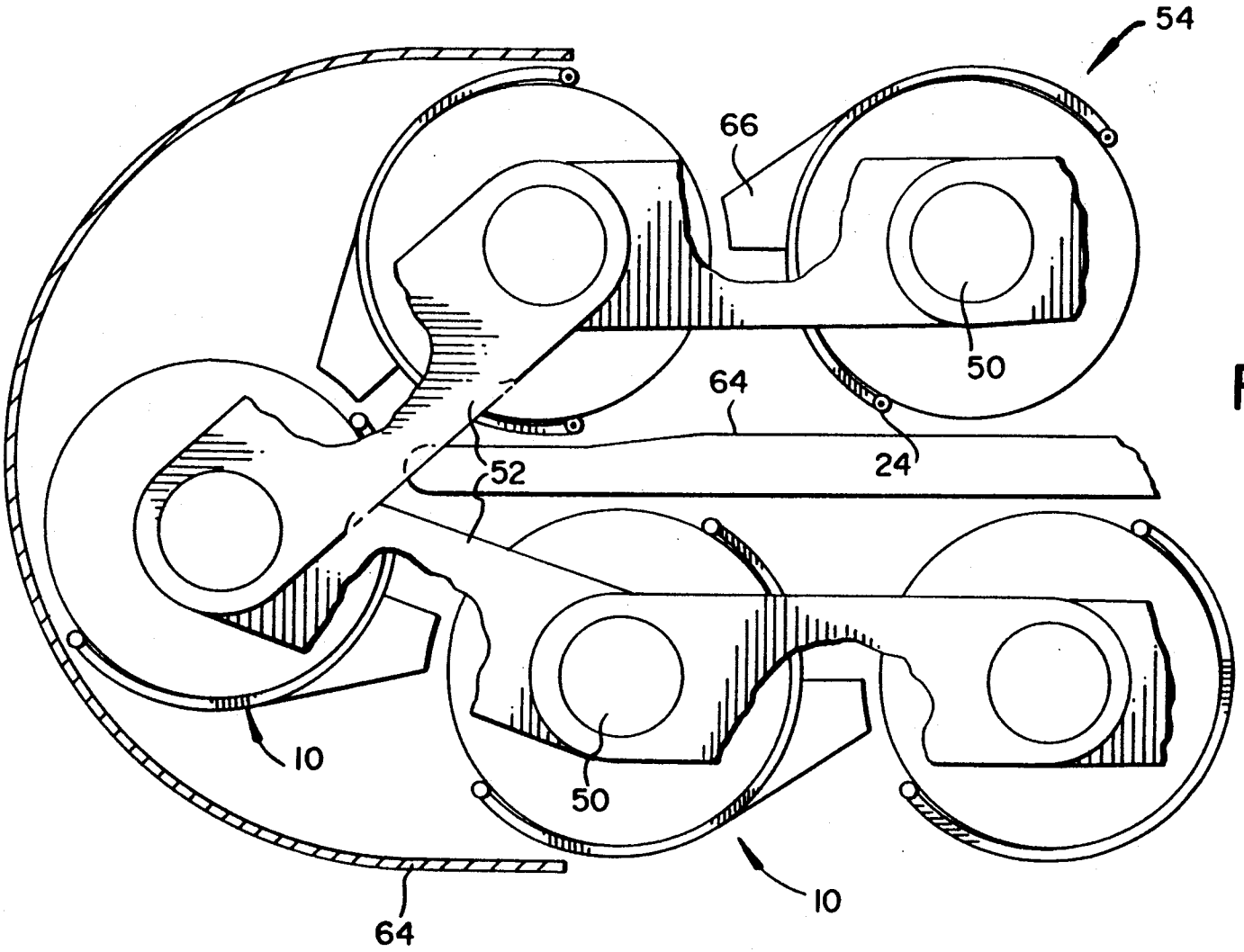
FIG. 7 is a side view of a magazine conveyor incorporating a series of ammunition round carriers of the basic structure seen in FIG. 1.

Turning to FIGS. 7 and 8, the bucket carrier endplates 14 are equipped with outwardly extending posts 50 for receiving the apertured ends of chain links 52 pivotally interconnecting a series of bucket carriers 10 in ladder chain fashion to create a magazine conveyor, generally indicated at 54. As seen in FIG. 8, the free ends of the posts extending beyond the links carry rollers 56 running in stationary guide channels 58 to support and direct the conveyor along a typically endless serpentine path throughout the magazine interior. Additional rollers 60 carried by the links 52 are engaged by sprockets (not shown) to drive the conveyor. Also seen are anti-rotation pins 62, connecting the bucket carriers to intermediate points on the links 52 to maintain an appropriate angular orientation of the bucket carriers during conveyance, a necessity during uploading and downloading of ammunition rounds as will be appreciated from FIGS. 9 and 10.

Returning to FIG. 7, it may be desirable to provide magazine guides 64 stationed along critical sections of the conveyor path to prevent ammunition rounds 26 from spuriously popping out of the bucket carriers in response to extreme inertial loading. These guides are preferably positioned in clearance relation with the ammunition rounds during conveyor operation so as not to create unnecessary power-sapping frictional drag on the conveyor drive and to avoid abrasion of the ammunition peripheral surface. However, the guides are sufficiently close such that they engage an exiting ammunition before it achieves an overcenter position relative to the restraining rollers 24. Thus, when the inertial loading sufficiently subsides, resilient fingers 20 can snap the round back into bucket 12. The proximate positioning of these guides can also serve to stop opening flexure of the fingers before an ammunition round can achieve an overcenter relationship vis-a-vis the rollers. Also illustrated is an alternative or supplemental popout restraint in the form of an arm 66 carried by each bucket and directed toward the slot of its neighboring bucket. The arms terminate short of engaging the ammunition round confined in the neighboring buckets, but, as in the case of guides 64, are sufficient close to prevent them from achieving overcenter relations with the restraining rollers when subjected to extreme inertial loading. Thus, when the load subsides, the fingers can snap the rounds back into place within the buckets.

Figure 9:
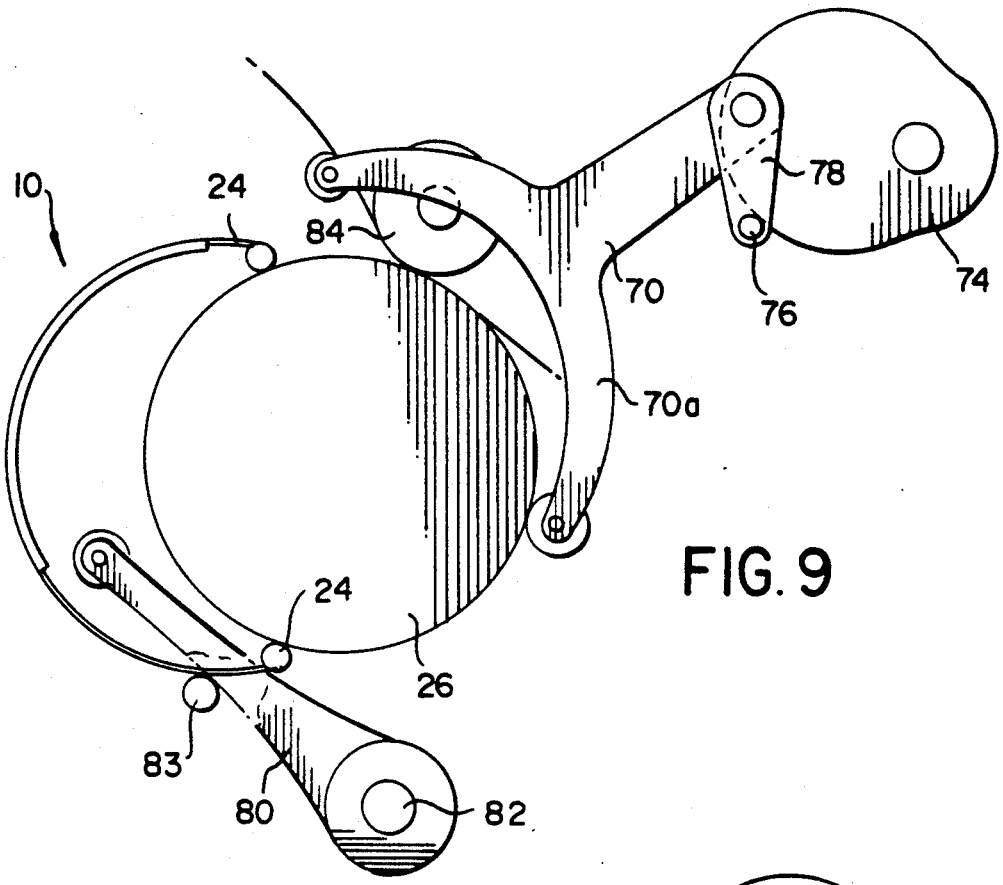
FIG. 9 is a simplified side view of transfer apparatus for uploading ammunition rounds into successive carriers of the magazine conveyor of FIG. 7.
Figure 10:
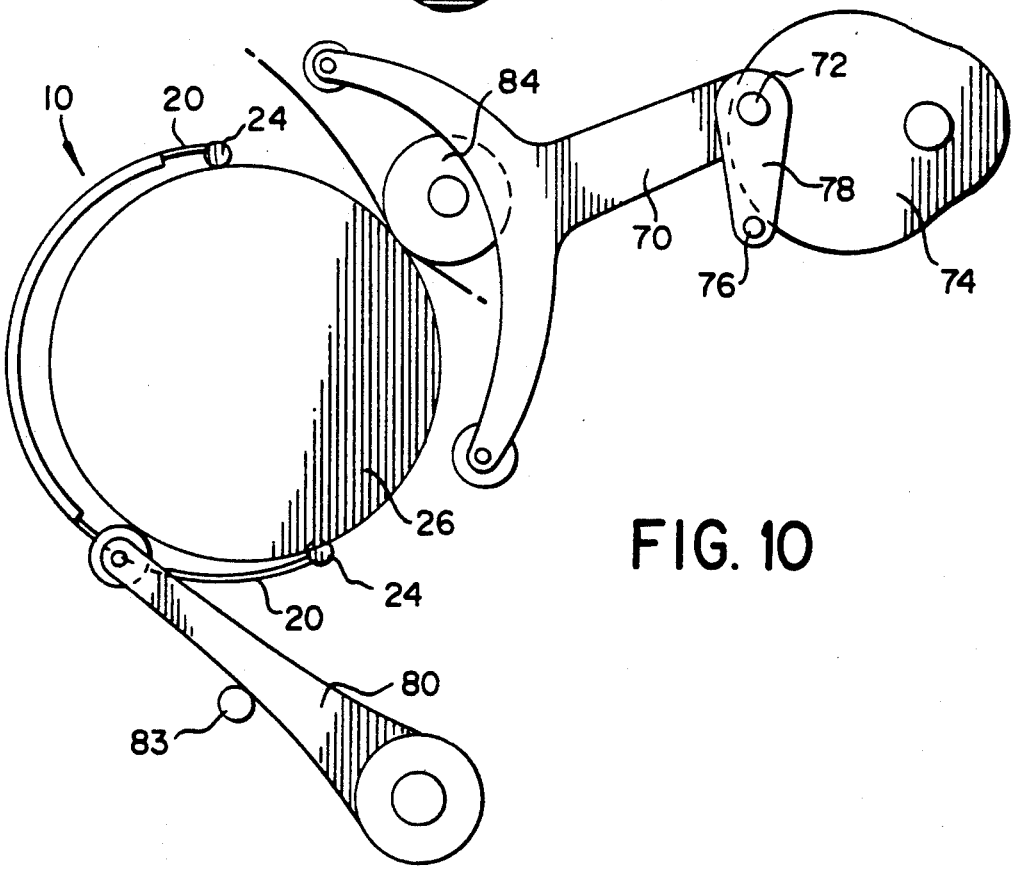
FIG. 10 is a simplified side view of the transfer apparatus of FIG. 9 operating to download ammunition rounds from the magazine conveyor carriers.

FIGS. 9 and 10 illustrate uploading and downloading the bucket carriers of the present invention utilizing ammunition transfer apparatus such as is disclosed in commonly assigned, copending application D. L. Maher entitled "Ammunition Transfer Apparatus for Uploading and Downloading a Magazine, Ser. No. 07/726,417, filed Jul. 5, 1991. Referring first to FIG. 9, to upload an ammunition round 26 into a bucket carrier 10 swinging through a 180° turnaround segment of the conveyor path in the counter clockwise direction, a set of transfer forks 70 mounted on a common shaft 72 are swing in a clockwise direction by an operating cam 74 acting on a cam follower 76 carried at the free end of a crank arm 78 affixed to the transfer fork shaft. In the process, an ammunition round is rolled off a linear conveyor (not shown) by the roller-tipped trailing transfer fork tine 70*a* and ultimately onto the upper surfaces of a set of selector gates 80 carried on a common shaft 82, which are swung counter clockwise to their illustrated positions against a stop 83 by the weight of the ammunition round. With appropriate timing, the ammunition round, while supported by the selector gates, is presented to the open slot of a bucket carrier at the proper moment during its swing through the turnaround. Continued clockwise motion of the transfer forks and counter clockwise motion of the conveyor, in concert with the presence of a fixed insertion roller 84, produce the requisite insertion forces on the rollers 24 to flex fingers 20 outwardly and widen the slot opening, clearing the way for insertion of the ammunition round into the bucket. Once in place, the fingers snap back, to press their rollers 24 into motion restraining engagement with the ammunition round. It will be appreciated that the selector gates are longitudinally positioned on their shaft 82 in alignment with the gaps between fingers, such that, in their illustrated uploading positions, interference with the bucket carriers is avoided.

To download ammunition rounds, selector gates 80 are driven to their counter clockwise-most position against stop 83 and transfer forks 70 are propelled to their clockwise-most positions illustrated in FIG. 10 in properly timed relation to the clockwise entry of a bucket carrier into the turnaround. As the ammunition round to be download passes under insertion roller 84, the roller tips of the selector gates intercept the round periphery through the gaps between fingers 20. With continued clockwise motion, the selector gates, hard against stop 83, create the force necessary to flex fingers outwardly to a sufficient slot opening width, and the ammunition round is snapped out of the bucket carrier. As the bucket carrier continues on, the now freed ammunition round rolls down over the upper surfaces of the selector gates under the control of transfer forks 70 which are now being swung in the counter clockwise direction by operating cam 74. For a detailed description of these uploading and downloading operations, reference may be had to the above cited copending application, the disclosure of which is specifically incorporated herein by reference. It will be appreciated however that transfer apparatus differing from that disclosed therein may be readily adapted to upload and download the bucket carriers of present invention.

It is seen from the foregoing that the objectives indicated above, including those made apparent in the Detailed Description, are efficiently attained, and, since certain changes may be made in the constructions set forth without departing from the scope of the invention, it is intended that matters of detail be taken as illustrative, and not in a limiting sense.

Having described the invention, what is claimed as new and desired to secure by Letters Patent is:

1. In a magazine conveyor, an ammunition round carrier comprising, in combination:

A. a semi-cylindrical bucket having a diameter conforming to a diameter of an ammunition round and circumferentially opposed edges defining an axially elongated slot;

B. a plurality of resilient fingers integral with said bucket, said fingers extending from said opposed edges at axially distributed locations to present free finger ends in said slot;

C. at least one roller rotatably mounted to said free end of each said finger, said rollers defining a slot opening having a width less than the diameter of an ammunition round, said rollers providing rolling contact with an ammunition round as said fingers flex to accommodate forcible insertion and withdrawal of an ammunition round through said slot opening into and out of said bucket.

2. The ammunition round carrier defined in claim 1, wherein said fingers extend circumferentially into said slot to define an ammunition round cradling angle in excess of 180°.

3. The ammunition round carrier defined in claim 2, wherein said cradling angle is in excess of 200°.

4. The ammunition round carrier defined in claim 2, wherein said rollers have peripheral surfaces fashioned to exert axial motion restraint on an ammunition round in said bucket.

5. The ammunition round carrier defined in claim 4, wherein said roller peripheral surfaces are serrated.

6. The ammunition round carrier defined in claim 4, wherein said fingers carry axially oriented pins at said free ends thereof, said rollers having hubs of a low friction material journalled on said pins, said hubs mounting sleeves of a high friction material to provide said axial motion restraint peripheral surfaces.

7. The ammunition round carrier defined in claim 4, which further includes ammunition round engaging friction pads affixed to said bucket in positions to supplement the axial motion restraint exerted by said rollers.

8. The ammunition round carrier defined in claim 4, wherein an inner surface section of said bucket includes radially outwardly projecting resilient tabs for latchingly engaging a annular radial surface feature of an ammunition round to provide enhanced axial motion restraint in one direction.

9. The ammunition round carrier defined in claim 4, wherein said bucket further includes a radially inwardly projecting stop positioned to engage a ogive of an ammunition round to limit nose-first axial motion of the projectile in said bucket.

10. The ammunition round carrier defined in claim 4, which further includes means affixed at each end of said bucket for pivotally interconnecting a series of said carriers in ladder chain fashion to form said magazine conveyor.

11. An ammunition magazine conveyor including a series of ammunition round carriers pivotally interconnected by a pair of conveyor chains, each said carrier comprising, in combination:

A. a semi-cylindrical bucket having a diameter conforming to a diameter of an ammunition round and circumferentially opposed edges defining an axially elongated slot;

B. end plates affixed to said bucket and having outwardly projecting posts for pivotal connections into the conveyor chains;

C. a plurality of resilient fingers integral with said bucket, said fingers extending circumferentially from said opposed edges at axially distributed locations to present free finger ends in said slot;

D. at least one roller rotatably mounted by said free end of each said finger to define a slot opening of a width less than the diameter of an ammunition round, said rollers providing rolling contact with an ammunition round as said fingers flex to accommodate insertion and withdrawal of an ammunition round through said slot opening into and out of said bucket, said rollers having peripheral surfaces fashioned to impose axial motion restraint on an ammunition round while in said bucket in response to clamping forces exerted by said fingers.

12. The magazine conveyor defined in claim 11, wherein said fingers provide an ammunition round cradling angle in excess of 180°.

13. The magazine conveyor defined in claim 12, which further includes fixed magazine guides located along a path of said conveyor in clearance relation to ammunition rounds confined in said buckets, said guides positioned to engage ammunition rounds attempting to exit said buckets through said slot openings before achieving overcenter relationships with said rollers.

14. The magazine conveyor defined in claim 12, wherein said bucket of each said carrier mounts a pop-out restraint arm for projection toward an adjacent said carrier of said conveyor, said arm having a free end positioned to engage an ammunition round attempting to exit said bucket of said adjacent carrier through said slot opening before achieving an overcenter relationship with said rollers of said adjacent carrier.

15. The magazine conveyor defined in claim 12, which further comprises transfer apparatus stationed at a turnaround in a conveyor path, said transfer apparatus including transfer forks and a fixed insertion roller acting in concert to upload an ammunition rounds into said buckets of successive said carriers while moving through said turnaround in one direction by forcibly inserting the ammunition rounds through said slot openings thereof.

16. The magazine conveyor defined in claim 15, wherein said transfer apparatus further includes oscillating selector gates having roller tips selectively positioned to intercept ammunition rounds confined in said buckets while moving through said turnaround in a direction opposite said one direction, whereby to forcibly extract the ammunition rounds from said carriers through said slot openings for controlled downloading by said transfer forks.

17. The magazine conveyor defined in claim 12, wherein at least one endplate of said end plates of each said carrier is connected to one of said conveyor chains by an anti-rotation pin to maintain desired angular orientations of said carrier relative to said conveyor chains.

18. The magazine conveyor defined in claim 12, wherein said roller peripheral surfaces are serrated.

19. The magazine conveyor defined in claim 12, wherein said fingers carry axially oriented pins at said frees thereof, said rollers having hubs of a low friction material journalled on said pins, said hubs mounting sleeves of a high friction material to provide said axial motion restraint peripheral surfaces.

20. The magazine conveyor defined in claim 12, which further includes ammunition round engaging friction pads affixed to said bucket in positions to supplement the axial motion restraint exerted by said rollers.

* * * * *